US005552852A

United States Patent [19]

Tsuchiya et al.

[11] Patent Number: 5,552,852

[45] Date of Patent: Sep. 3, 1996

[54] DEVICE OF DISSOLVING AND REPLENISHING SOLID PROCESSING AGENTS FOR A SILVER HALIDE PHOTOGRAPHIC LIGHT-SENSITIVE MATERIAL AND AUTOMATIC PROCESSING MACHINE FOR SILVER HALIDE PHOTOGRAPHIC LIGHT-SENSITIVE MATERIAL EQUIPPED WITH THE DEVICE

[75] Inventors: Ichiro Tsuchiya; Tsuyoshi Haraguchi, both of Hino, Japan

[73] Assignee: Konica Corporation, Tokyo, Japan

[21] Appl. No.: 345,637

[22] Filed: Nov. 28, 1994

[30] Foreign Application Priority Data

Dec. 3, 1993 [JP] Japan ..... 5-304298

[51] Int. Cl.[6] ..... G03D 3/02

[52] U.S. Cl. ..... 354/324; 354/331

[58] Field of Search ..... 354/319–324, 354/331, 336; 430/450, 465, 30, 398–400

[56] References Cited

U.S. PATENT DOCUMENTS

| | | | |
|---|---|---|---|
| 5,318,061 | 6/1994 | Saito | 354/324 X |
| 5,351,103 | 9/1994 | Komatsu et al. | 354/324 |
| 5,400,105 | 3/1995 | Koboshi | 354/324 |
| 5,402,196 | 3/1995 | Ishida et al. | 354/324 |

FOREIGN PATENT DOCUMENTS

| | | |
|---|---|---|
| 0537788A3 | 4/1993 | European Pat. Off. . |
| 5-107698 | 4/1993 | Japan . |
| 5-113646 | 5/1993 | Japan . |
| 5-119454 | 5/1993 | Japan . |
| 5-127341 | 5/1993 | Japan . |
| WO92/20013 | 11/1992 | WIPO . |

OTHER PUBLICATIONS

Patent Abstracts of Japan, vol. 17, No. 498 (P–1609) Sep. 8, 1993 & JP–A–05 127 341 (Fuji Photo Film) May 25, 1993.

*Primary Examiner*—D. Rutledge

*Attorney, Agent, or Firm*—Frishauf, Holtz, Goodman, Langer & Chick

[57] ABSTRACT

A device to dissolve solid processing agents and to replenish the dissolved processing agents to an automatic processing apparatus for a silver halide photographic light-sensitive material which has a processing tank and a circulating path for a processing solution provided in the processing tank. The device includes a dissolving tank for storing a dissolved solution therein, and a processing solution supplier provided between the processing tank and the dissolving tank independent of the circulating path, which supplies the processing solution from the processing tank to the dissolving tank. The device further includes a replenisher to replenish the dissolved solution from the dissolving tank to the processing tank. The dissolving tank and the processing tank are communicated through another circulating path.

20 Claims, 14 Drawing Sheets

DEVICE OF DISSOLVING AND REPLENISHING SOLID PROCESSING AGENTS FOR A SILVER HALIDE PHOTOGRAPHIC LIGHT-SENSITIVE MATERIAL AND AUTOMATIC PROCESSING MACHINE FOR SILVER HALIDE PHOTOGRAPHIC LIGHT-SENSITIVE MATERIAL EQUIPPED WITH THE DEVICE

BACKGROUND OF THE INVENTION

The present invention relates to an automatic processing machine (hereinafter referred to also as an automatic processor) for a silver halide photographic light-sensitive material (hereinafter referred to also as a light-sensitive material), and more specifically, to a device of dissolving and replenishing solid processing agents that supplies solid processing agents to the automatic processor mentioned above.

In recent years, Japanese Patent Publication Open to Public Inspection No. 127341/1993 (hereinafter referred to as Japanese Patent O.P.I Publication) and others disclose, from the viewpoint of laborsaving for operators, a means for dissolving solid processing agents used for processing silver halide photographic light-sensitive materials. The device described in the above-mentioned official gazette is a device for preparing a replenisher by dissolving processing agents of a powder type automatically and for supplying the replenisher to an automatic processing machine, emphasizing that operations of operators can be reduced because processing agents are dissolved automatically.

However, in the case of the aforementioned dissolving device wherein a large quantity of replenishers are normally prepared through dissolving at a time, when a processing volume per day is small, for example, the replenishers are forced to stay in a dissolving tank for a long time and thereby are deteriorated by aerial oxidation because a quantity of color developing replenishers prepared already to be supplied to an automatic processor is small. Therefore, replenishers deteriorated gradually are supplied to the automatic processor, which has proved to have problems that photographic performance is deteriorated and oxidized developing agents stick to light-sensitive material, causing smudge thereon and unstable processing characteristics.

In addition to the above, it is impossible to replenish a replenisher solution that is being dissolved while the replenisher is being prepared. Therefore, replenishment is suspended. When the replenishment suspension time is long, continuous processing is suspended and thereby the working property is deteriorated remarkably. For the problems mentioned above, Japanese Patent O.P.I. Publication No. 127341/1993 discloses a technology wherein a dissolving device is equipped with a reservoir tank for a prepared replenisher. However, this technology still has a problem that a dissolving device itself needs to be large in size because a dissolving tank and a reservoir tank are provided separately.

For the purpose of shortening the replenishment suspension time, on the other hand, it can be considered that the solubility of solid processing agents is enhanced. When physical characteristics of solid processing agents are considered, however, there is a limit for the shortening of dissolving time. Another means for shortening the replenishment suspension time is to reduce an amount of dissolving. However, a reduction of dissolving amount leads to an increase in dissolving (replenishing) frequencies, which increases a load for an operator on the contrary.

For those problems mentioned above, Japanese Patent O.P.I. Publication Nos. 119454/1993, 113646/1993 and 107698/1993 disclose a method wherein solid processing agents are supplied directly to a processing tank of an automatic processor for replenishment. Owing to the aforementioned method wherein solid processing agents are replenished directly to the processing tank, an operator is freed from the work of preparing replenishers, and problems in processing caused by deterioration of replenishers created by decreasing replenishers are solved.

However, when the aforementioned method is intended to be applied to a conventional automatic processor, not only a solid processing agent supplying device directly to the automatic processor and a precision device for controlling the supply of solid processing agents are required to be installed newly but also large-scale modification of the automatic processor is needed for the installation of the two mentioned above. This may be a burden for both a user and a manufacturer of the automatic processor. Further, a method for controlling the supply of solid processing agents varies depending upon automatic processors including physical characteristics of each solid processing agent, a supplying method, specifications of the automatic processor. Therefore, controlling devices and dissolving devices both in several types are needed, which cause an increase in production cost and are not desirable.

SUMMARY OF THE INVENTION

The first object of the invention is to improve the working property of a user who uses a conventional automatic processor. The second object of the invention is to provide a stable processing method for replenishing processing agents. The third object of the invention is to provide a dissolving device which is compact and inexpensive.

The first embodiment of the invention is represented by a device of dissolving and replenishing solid processing agents for a silver halide photographic light-sensitive material that replenishes to an automatic processing machine for processing a silver halide photographic light-sensitive material having therein a circulating path for processing solution provided in a processing tank, wherein a means for supplying a processing solution from the aforementioned processing tank to a dissolving tank and a means for replenishing a dissolved solution from the aforementioned dissolving tank to the aforementioned processing tank are provided, independently of the circulating path, between the processing tank of the automatic processing machine and the dissolving tank of the dissolving device, and the processing tank and the dissolving tank are communicated through a communicating means.

The second embodiment of the invention is represented by the device of dissolving and replenishing solid processing agents for a silver halide photographic light-sensitive material according to the first embodiment wherein the dissolving tank and the processing tank both mentioned above are communicated through a circulating path.

The third embodiment of the invention is represented by the device of dissolving and replenishing solid processing agents for a silver halide photographic light-sensitive material according to the first embodiment or the second embodiment wherein a height of the liquid-level in the dissolving tank and that of the liquid-level in the processing tank are substantially the same.

The fourth embodiment of the invention is represented by the device of dissolving and replenishing solid processing agents for a silver halide photographic light-sensitive material according to the first through third embodiments wherein the dissolving device is equipped with a solid processing agent supply means and a supply-controlling means that controls the solid processing agent supply means mentioned above.

The fifth embodiment of the invention is represented by the device of dissolving and replenishing solid processing agents for a silver halide photographic light-sensitive material according to any one of the first through fourth embodiments wherein the dissolving device has a water-supply tank, a water-supply means that supplies water from the water-supply tank to the dissolving tank, and a water-supply control means that controls the water-supply means.

The sixth embodiment of the invention is represented by the device of dissolving and replenishing solid processing agents for a silver halide photographic light-sensitive material according to any one of the first through fifth embodiments wherein the dissolving device has a control means that controls dissolution of solid processing agents.

The seventh embodiment of the invention is represented by the device of dissolving and replenishing solid processing agents for a silver halide photographic light-sensitive material according to any one of the first through sixth embodiments wherein the solid processing agent supply means mentioned above is controlled to supply solid processing agents to the dissolving tank depending on information of volume of light-sensitive materials processed in the automatic processing machine.

The eighth embodiment of the invention is represented by the device of dissolving and replenishing solid processing agents for a silver halide photographic light-sensitive material according to any one of the first through sixth embodiments wherein the dissolution control means mentioned above controls dissolution of solid processing agents depending on information of volume of light-sensitive materials processed in the automatic processing machine.

The ninth embodiment of the invention is represented by the device of dissolving and replenishing solid processing agents for a silver halide photographic light-sensitive material according to any one of the first through sixth embodiments wherein the solid processing agent supply means is controlled to supply solid processing agents to the dissolving tank depending on information of volume of solid processing agents supplied.

The tenth embodiment of the invention is represented by the device of dissolving and replenishing solid processing agents for a silver halide photographic light-sensitive material according to any one of the first through sixth embodiments wherein the dissolution control means controls dissolution of solid processing agents depending on information of volume of solid processing agents supplied.

The eleventh embodiment of the invention is represented by the device of dissolving and replenishing solid processing agents for a silver halide photographic light-sensitive material according to any one of the first through tenth embodiments wherein the dissolution control means is one selected from the group including a liquid flow stirring means employing a circulating pump, a stirring means employing a propeller and supersonic waves.

The twelfth embodiment of the invention is represented by the device of dissolving and replenishing solid processing agents for a silver halide photographic light-sensitive material according to any one of the first through eleventh embodiments wherein the dissolution control means is a liquid flow stirring means employing a circulating pump.

The thirteenth embodiment of the invention is represented by the device of dissolving and replenishing solid processing agents for a silver halide photographic light-sensitive material according to any one of the first through twelfth embodiments wherein the dissolution control means to the dissolved solution replenishing means to replenish from the dissolving tank to the processing tank are conducted through the same circulation pump.

The fourteenth embodiment of the invention is represented by the device of dissolving and replenishing solid processing agents for a silver halide photographic light-sensitive material according to any one of the first through thirteenth embodiments wherein the device has a plurality of dissolving tanks each containing a processing solution of a different formula.

The fifteenth embodiment of the invention is represented by an automatic processing machine equipped with the device of the dissolving and replenishing solid processing agents described in any one of the first through fourteenth embodiments.

The sixteenth embodiment of the invention is represented by the device of dissolving and replenishing solid processing agents for a silver halide photographic light-sensitive material according to any one of the first through fifteenth embodiments wherein the device is connected to a plurality of automatic processing machines.

DETAILED DESCRIPTION OF THE PREFERRED EMBODIMENTS

Figure 1:
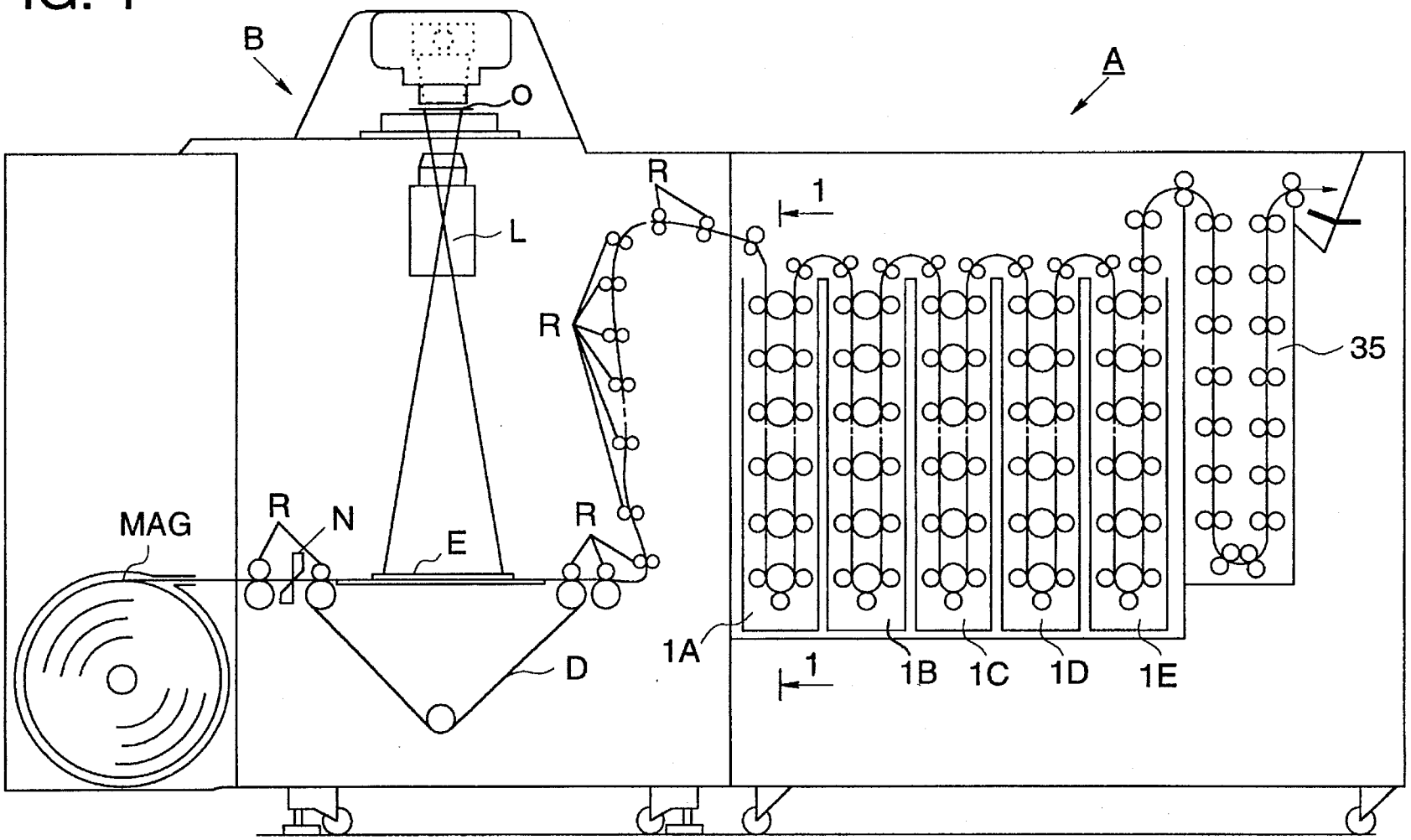
FIG. 1 is a schematic structural diagram of a printer processor wherein an automatic processing machine and a photographic printing unit are united solidly.

An example of an automatic processor to which the present invention can be applied will be explained as follows. FIG. 1 is a schematic diagram of a printer processor wherein automatic processor A and photographic printing unit B are united solidly.

In FIG. 1, magazine MAG containing a roll-shaped photographic paper that is an unexposed silver halide photographic light-sensitive material is set at the lower left corner of photographic printing unit B. A photographic paper pulled out of the magazine is cut into a predetermined size through conveyance roller R and cutter N to be a sheet paper. This sheet paper is conveyed by belt-type conveyance means D to exposure position E where the sheet paper is exposed to an image of original O. The sheet paper already exposed is further conveyed by plural pairs of conveyance rollers R, and is led into automatic processor A. In the automatic processor A, the sheet paper is conveyed by roller-type conveyance means (not provided with any symbol) to pass through processing tanks such as color developing tank 1A, bleach-fixing tank 1B, stabilizing tanks 1C, 1D and 1E (3-tank structure, substantially) in succession, whereby color development processing, bleach-fixing processing and stabilizing process are conducted. The sheet paper which has been subjected to each processing mentioned above is dried at drier section 35 and then is ejected to the outside of the machine.

Incidentally, chain lines in the figure show a conveyance path for silver halide photographic light-sensitive materials. Though light-sensitive materials are led to and threaded through automatic processor A in the form of a sheet in the example, they may also be led to and threaded through the automatic processor A in the form of a strip. In that case, when an accumulator that absorbs a light-sensitive material temporarily is provided between the automatic processor A and photographic printing unit B, the processing efficiency is increased. The automatic processor related to the invention may naturally be structured either to be united solidly with the photographic printing unit B or to be an independent automatic processor. Further, a silver halide photographic light-sensitive material that is processed by the automatic processor of the invention is not limited only to an exposed photographic paper but it may also be an exposed negative film naturally. Further, although the automatic processor which is substantially of a 3-tank structure including a color developing tank, a bleach-fixing tank and stabilizing tanks has been used for the explanation of the invention, the invention is not limited to this, and it can be applied also to an automatic processor which is substantially of a 4-tank structure including a color developing tank, a bleaching tank, a fixing tank and a stabilizing tank.

Figure 2:
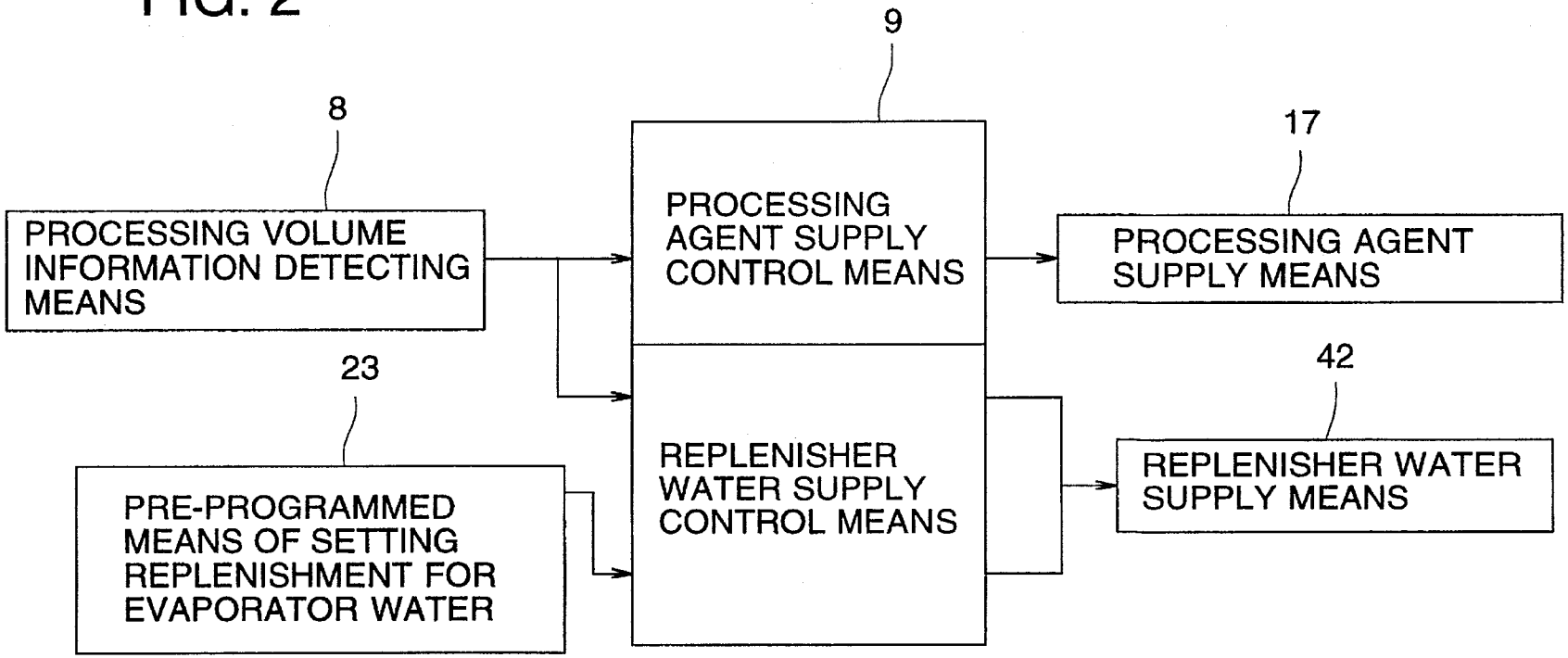
FIG. 2 is a block diagram including a control means for an automatic processing machine.

Next, behavior of the invention will be explained as follows, referring to FIG. 2. With regard to a light-sensitive material which has been exposed to light, information of processing volume therefor is detected by processing volume information detecting means 8 when the light-sensitive material is located at an inlet on automatic processor A. Processing agent supply control means 9 sends supply signals to processing agent supply means 17 based on processing volume information detected by the processing volume information detecting means 8, when the sum of areas of light-sensitive materials to be processed reaches the predetermined area. The processing agent supply means 17 which has received the supply signals supplies a tablet to a filtration section in a solid processing agent supply unit by pushing out the tablet with a pushing-out member. The supplied tablet is dissolved in a processing solution in the solid processing agent supply unit and the dissolution of the tablet is accelerated by a processing solution which is circulated by a circulation means in the sequence of "processing section→circulation pump→solid processing agent supply unit→communicated window→processing section". As a dissolution controlling means for a solid processing agent, it is possible to use the known means, and from the viewpoint of an effect, the preferable arrangement includes a liquid flow stirring means employing a circulating pump, a stirring propeller means employing a propeller or a stirrer and a supersonic stirring means, among which the liquid flow stirring means employing a circulating pump is especially preferable from the viewpoint of easiness of an apparatus and piping. A replenisher water supply control means, on the other hand, sends water replenishment signals to a replenishing water supply means 42 (a warm water supply unit and an electromagnetic valve) based on processing volume information obtained by a processing volume information detecting means through detection, when the sum of areas of light-sensitive materials to be processed reaches the predetermined area. Or, it is also possible to provide preprogrammed means of setting replenishment for evaporator water 23 which is programmed in advance so that water in a necessary amount can be supplied in accordance with processing volume information detected by the processing volume information detecting means 8, information about a liquid level in a processing tank and environmental information surrounding automatic processor A, and to send the information of the supply regulating means 23 to the replenisher water supply control means 9. Replenishing water supply means 42 which has received water replenishment signals controls the warm water supply unit and the electromagnetic valve to replenish, from a replenisher water tank, replenisher water in predetermined quantity or necessary quantity to each processing tank or the processing tank that needs replenishment. The predetermined area in this case is the same as that in processing agent supply control means 9. However, predetermined areas may differ from each other without being limited to the above. On the other hand, detected light-sensitive materials are conveyed by a roller conveyance means through processing tanks shown in FIG. 1 such as color developing tank 1A, bleach-fixing tank 1B, stabilizing tanks 1C, 1D and 1E successively in this order. The automatic processing machine mentioned above includes, for example, color negative film processors such as CL-NP30 (made by Konica Corp.), QA-II, CL-NP50QA (made by Fuji Photo Film Co.), FP-350AL, FP-560BAL (made by Noritsu Koki Co.), QSF-450L-3, QSF-4100L-3, a color paper printer processor and a color paper processor such as CL-PP801A, CL-PP811A and CL-PP1912 all made by Konica Corp., a micro-lab such as PL-P1032 made by Konica Corp. and QSS-M2CRO made by Noritsu Koki Co., and a reversal film processor such as QSF-R420L made by Noritsu Koki Co.. However, the invention is not limited to the foregoing.

Figure 3:
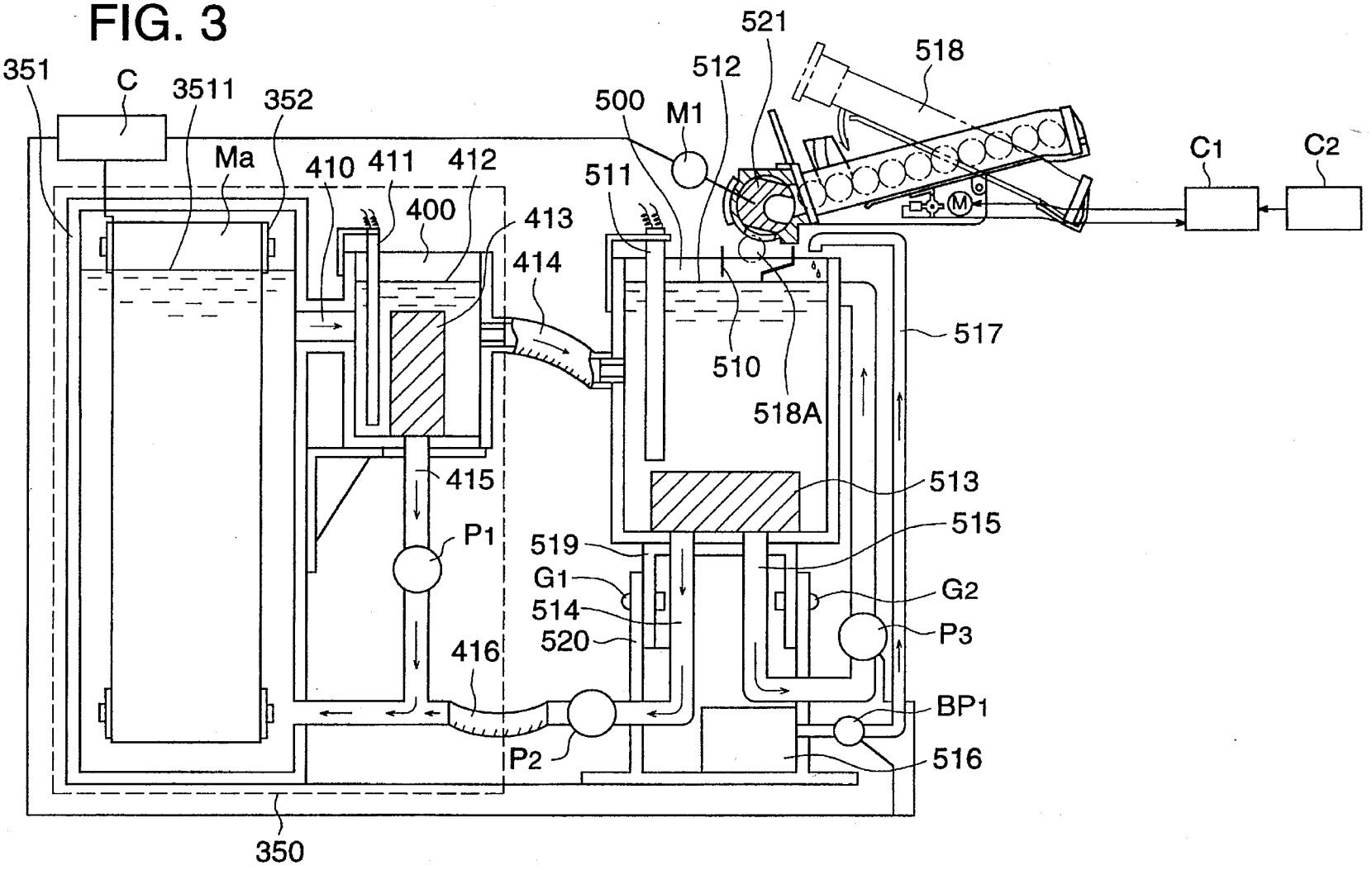
FIG. 3 is a general structural diagram wherein a processing tank and a dissolving tank both of the present invention are structured separately.

FIG. 3 shows one of color developing tank 1A, bleach-fixing tank 1B, and stabilizing tanks 1C, 1D and 1E all shown in FIG. 1 mentioned above as processing tank 351. In the processing tank 351, sheet-shaped photographic paper Ma conveyed by a large number of conveyance rollers 352 is processed with processing solution 3511. The numeral 400 represents a processing solution circulating tank provided solidly on the side of the aforementioned processing tank 351, and it is connected to the processing tank 351 through communicating pipe 410. The aforementioned processing solution 3511 is caused by circulating pump P1 to pass through filter 413 provided in the processing solution circulating tank 400 from its one side, and is circulated to the aforementioned processing tank 351 through leading pipe 415 to stay temporarily in the processing solution circulating tank 400 as processing solution 412 which is heated to the appropriate temperature by heater 411 provided in the aforesaid processing solution circulating tank 400. The aforementioned processing tank 351 is combined with the processing solution circulating tank 400 to make processing unit 350. The numeral 500 is a dissolving tank provided separately from the aforementioned processing tank 351 and/or the processing solution circulating tank for the purpose of dissolving solid processing agent 518A. The aforementioned solid processing agent 518A is guided by supply guide 510 to the dissolving tank 500 (whose capacity is preferably small from the viewpoint of a compact dissolving device, being concretely 100–5000 ml per tank and preferably 200–2000 ml, and whose open area rate is preferably 50 $cm^2/l$ or less from the viewpoint of preventing deterioration of processing solution caused by aerial oxidation), and is supplied into processing solution 512. Incidentally, with regard to an amount of the aforesaid solid processing agent to be supplied during one cycle of operation of solid processing agent supply module 518, processing agents of a tablet type are used as an example of the solid processing agent 518A, but it is also possible to use those of a granule type (those having an average particle size of 50–3000 μm) or those of a powder type (those having an average particle size of not more than 50 μm). It is possible to use those types of processing agents properly depending on an amount of replenishment of processing agents and their dissolving properties. The numeral 511 is a heater provided in the dissolving tank 500 mentioned above for keeping a temperature of processing solution 512, and it keeps the processing solution 512 at an appropriate temperature. There is further provided filter 513 in the dissolving tank 500. For the purpose of causing the processing solution 512 to flow directly or indirectly to the processing tank 351, the filter 513 is connected to the leading pipe 415 mentioned above through leading pipe 514, circulating pump P2 and connecting pipe 416 that is formed to be flexible. On the other hand, leading pipe 515 for the processing solution 512 is provided to run from the dissolving tank 500 to be in parallel with the leading pipe 514, and thereby the processing solution in the dissolving tank 500 is circulated through the filter 513 by circulating pump P3 (0.5–2.0 R/min), thus, dissolution of the solid processing agent 518A can be controlled. The circulating pump P3 can control the dissolving speed of solid processing agents by changing the flow rate of circulation based on processing volume information of light-sensitive materials and information of the volume of solid processing agents supplied, which is effective for processing stability in terms of concentration variation of processing solutions and others. The aforementioned dissolving tank 500 is supported on fixed supporting member 520 through supporting member 519 that is vertically adjustable. The supporting member 519 is adjusted vertically to the fixed supporting member 520 by means of adjusting screws G1 and G2 and thereby the aforementioned processing tank portion can be vertically adjusted and fixed so that the liquid level of the processing solution 512 in the dissolving tank 500, that of the processing solution 412 in the processing solution circulating tank 400 and that of the processing solution 3511 in the processing tank 351 may be on the same level. Between the dissolving tank 500 thus fixed and the processing solution circulating tank 400, there is provided connecting pipe 414 that is formed to be flexible. The numeral 516 is a water supply tank provided on the aforementioned fixed supporting member 520 to be located under the dissolving tank 500, and water in an appropriate quantity is supplied by bellows pump BP1 through water supply pipe 517 depending on the reduction of processing solution 512 in the dissolving tank 500. The numeral 518 is a solid processing agent supply device that supplies solid processing agents 518A automatically to the dissolving tank 500. In the solid processing agent supply device, there is provided rotary supply member 521 to which motor M1 is connected so that only a piece of the solid processing agent 518A may be taken in rotary supply member 521 to be supplied to the dissolving tank 500. The symbol C is a control member that detects processing volume for the aforementioned sheet-shaped photographic paper Ma and controls the motor $M_1$ and the bellows pump $BP_1$ both stated above. The symbols $C_1$ and $C_2$ represent a control section that activates motor M provided on the solid processing agent supply device 518, and the control section causes the motor M to rotate on a timely basis to give vibration to the solid processing agent supply device 518 on a timely basis so that solid processing agent 518A may be supplied smoothly to the rotary supply member 521.

Photographic papers of a sheet type Ma are conveyed by conveyance roller 352 successively in the processing tank 351 structured as explained above to be processed by processing solution 351, in which a part of the processing solution 3511 flows to the processing solution circulating tank 400 through communicating pipe 410, stays there temporarily as processing solution 412, and heated by heater 411 and circulated by circulating pump P1 to return to the processing tank 351. A part of the processing solution 412 flows to dissolving tank 500 through connecting pipe 414, and processing solution 512 is adjusted to appropriate concentration with aforesaid water and the solid processing agents 518A to be sent to the processing tank 351 by circulating pump P2 through filter 513, leading pipe 514 and the connecting pipe 416. With regard to the circulating flow rate of the processing solution 512, it is preferable, from the viewpoint of keeping the concentration variation small, that the relation of A>B is satisfied under the assumption that the circulating flow rate in the processing tank 351 is A and that in the dissolving tank 500 is B (A is 0.5–2.0R/min and B is 0.05–0.5 R/min). In this case, solid processing agents 518A are supplied and water is supplied by bellows pump $BP_1$ to the dissolving tank 500 as described above depending on processing volume of the photographic papers of a sheet type Ma.

Figure 4:
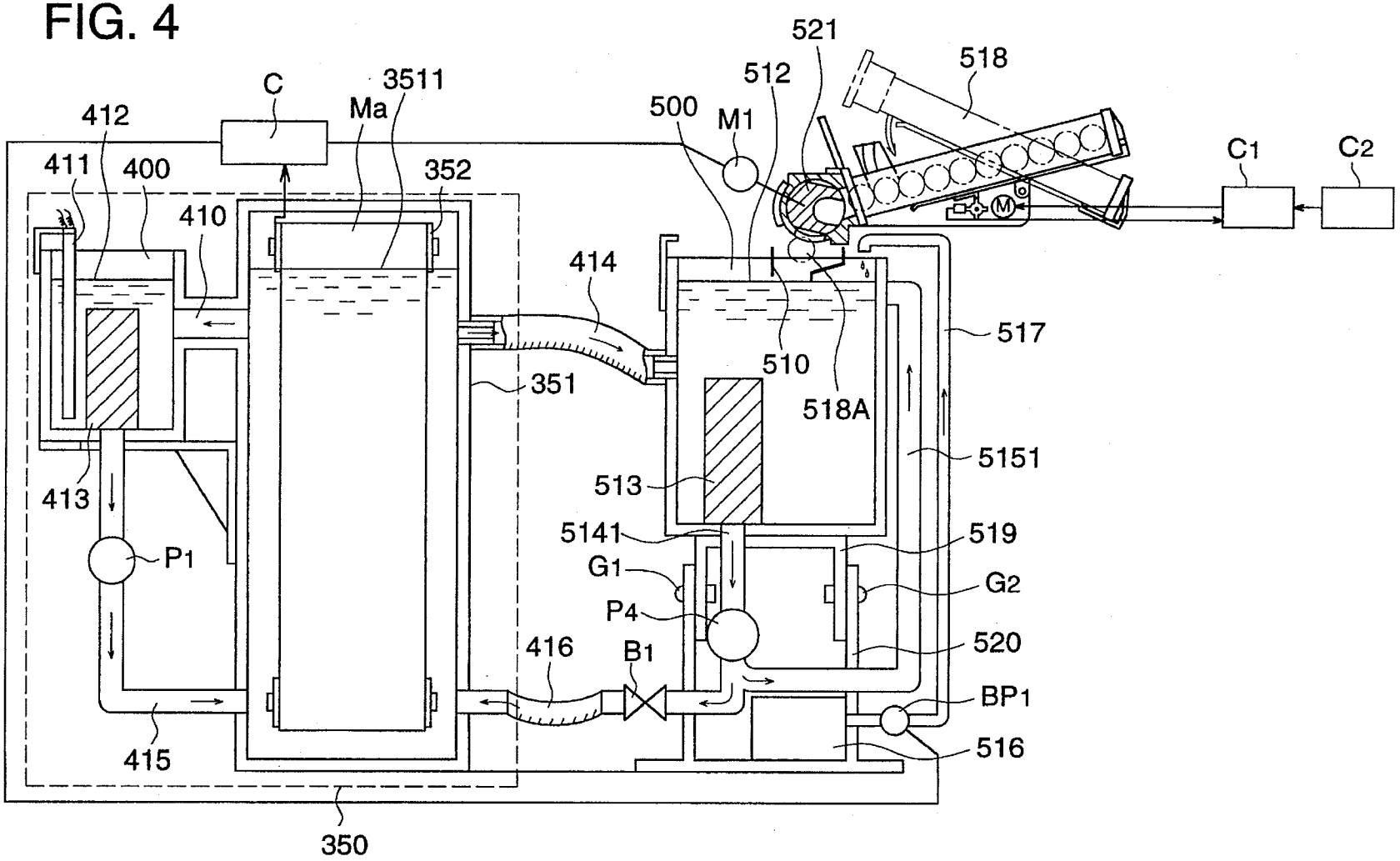
FIG. 4 is other general structural diagram wherein a processing tank and a dissolving tank both of the present invention are structured separately.

FIG. 4 shows an example other than that shown in FIG. 3 wherein processing tank 351 that processes the aforementioned photographic papers of a sheet type Ma and the dissolving tank 500 are connected directly not through processing solution circulating tank 400 but through connecting pipe 414, and leading pipe 5141 that circulates processing solution 512 from the dissolving tank 500 is provided with circulating pump P4 at which the leading pipe 5141 is divided into two one of which is connected to the processing tank 351 through connecting pipe 416. In this case, flow rate adjusting valve $B_1$ may be installed for adjusting the flow rate. The other of the two is used as leading pipe 5151 that is for dissolution accelerating circulation for solid processing agents 518A in processing solution 512. Due to the constitution mentioned above, it is possible to send processing solution 512 wherein solid processing agents 518A are dissolved to the processing tank 351 and to accelerate dissolution of solid processing agents 518A in dissolving tank 500 by providing only one circulating pump P4. This is preferable from the viewpoint of reducing the number of circulating pumps and making the piping simple. When sending processing solution 512 from dissolving tank 500 to processing tank 351, it is possible to send a processing solution in an appropriate amount by adjusting the flow rate with the aforementioned flow rate adjusting valve $B_1$. On the other side of the processing tank 351, there is affixed the processing solution circulating tank 400 wherein processing solution 3511 is heated as in FIG. 6 and is circulated by circulating pump P1. As in the above description, the position of dissolving tank 500 is adjusted by supporting member 519, fixed supporting member 520 and adjusting screws G1 and G2 so that the liquid level of the processing tank 351 and that of the dissolving tank 500 may be on the same level. Other structures are the same as those shown in FIG. 3.

Figure 5:
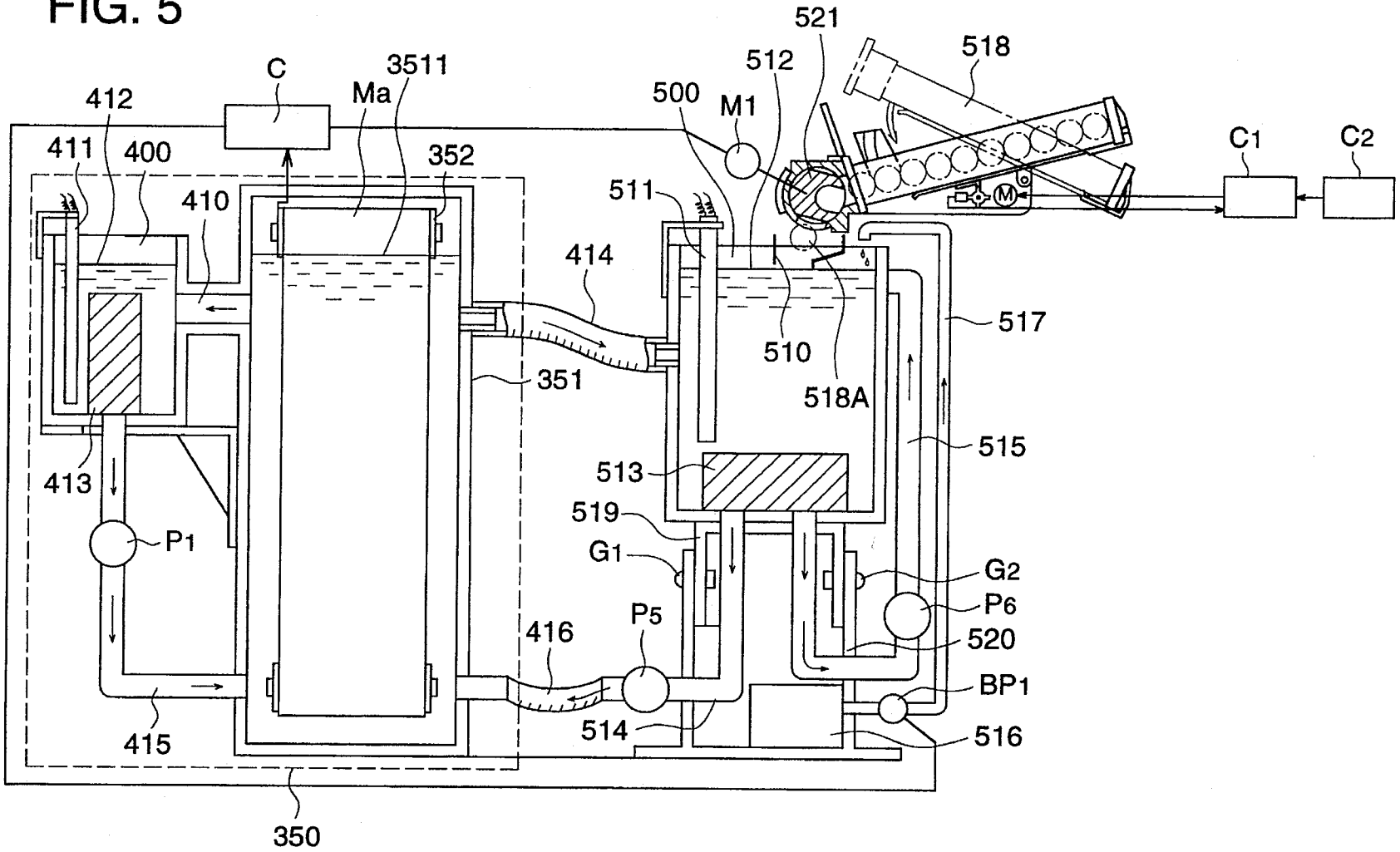
FIG. 5 is another general structural diagram wherein a processing tank and a dissolving tank both of the present invention are structured separately.
Figure 6:
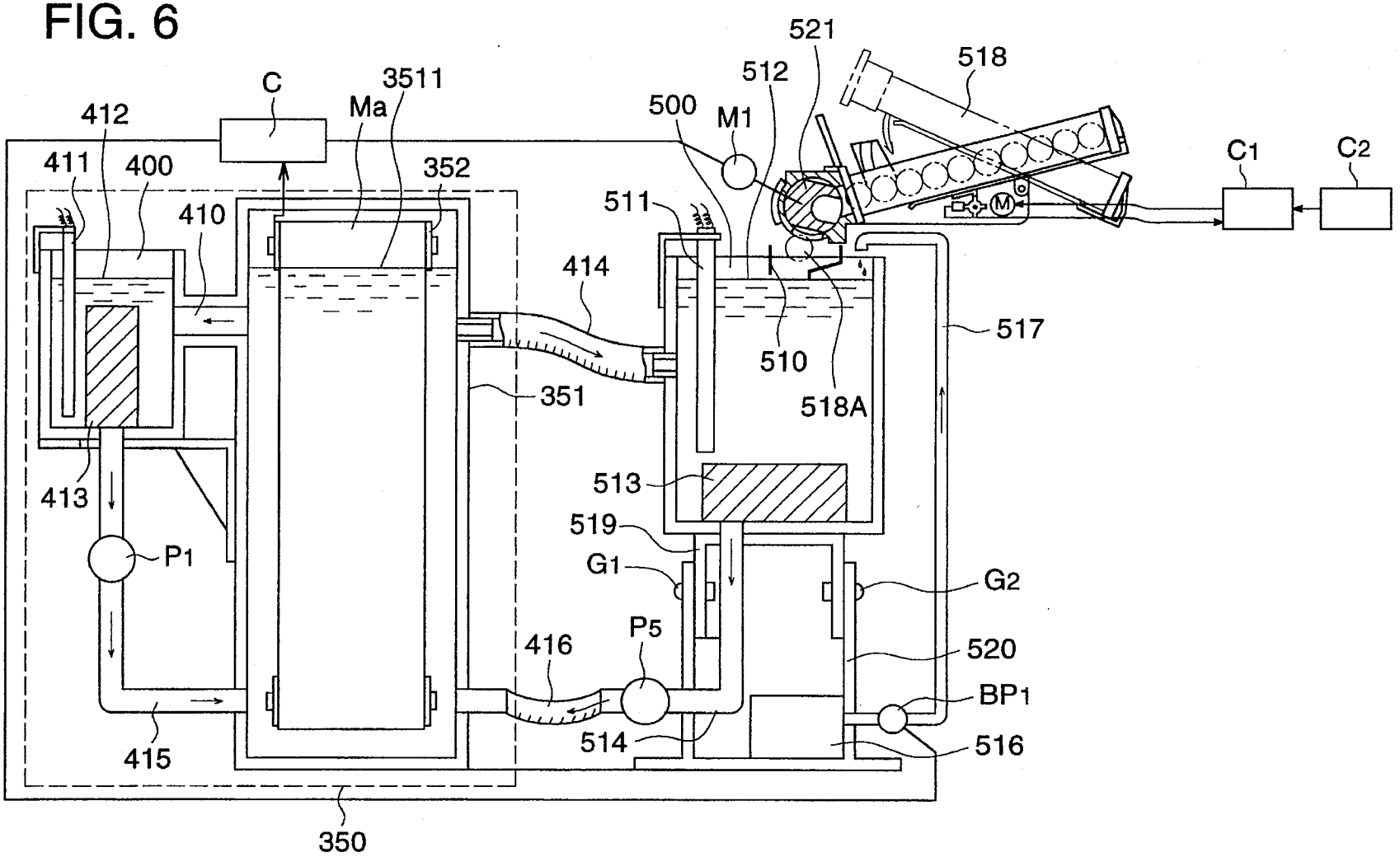
FIG. 6 is still another general structural diagram wherein a processing tank and a dissolving tank both of the present invention are structured separately.

FIG. 5 shows an example other than those shown in FIGS. 3 and 4. In the example, as in that shown in FIG. 4, dissolving tank 500 which is structured separately from processing tank 351 for dissolving solid processing agents 518A and the processing tank 351 are connected directly not through processing solution circulating tank 400 but through connecting pipe 414. On the other hand, processing solution 512 heated by heater 511 in dissolving tank 500 is sent by circulating pump P5 through leading pipe 514 and connecting pipe 416. In the present example, processing solution 512 circulated for accelerating dissolution of solid processing agents 518A is circulated directly by leading pipe 515 and circulating pump P6. On the other side of the processing tank 351, there is affixed processing solution circulating tank 400 wherein processing solution 412 heated by heater 411 is circulated to the processing tank 351 by circulating pump P1. In the present example, as in the foregoing, the position of the dissolving tank 500 is adjusted by supporting member 519, fixed supporting member 520 and adjusting screws G1 and G2 so that the liquid levels are on the same level. Other structures are the same as those shown in FIGS. 3 and 4. FIG. 6 shows an example wherein leading pipe 515 and circulating pump P6 provided in the example shown in FIG. 5 are eliminated.

Figure 7:
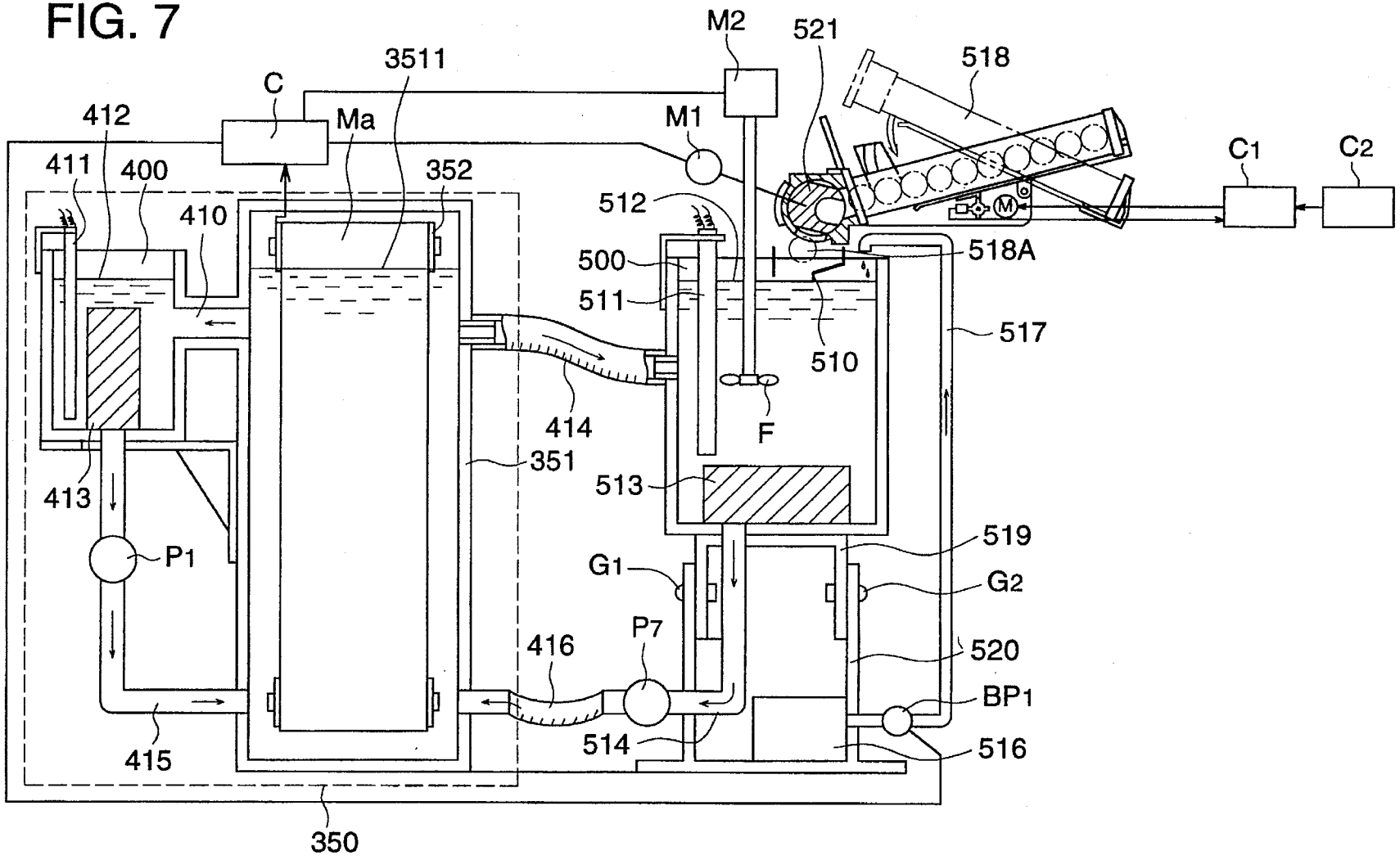
FIG. 7 is further general structural diagram wherein a processing tank and a dissolving tank both of the present invention are structured separately.

FIG. 7 shows an example other than those shown in FIGS. 3 and 4, 5 and 6. In the example, the structure is mostly the same as those shown in FIGS. 4 and 5. In the example, stirring member F that stirs processing solution 512 as a means for accelerating dissolution of the solid processing agents 518A is provided in the processing solution 512 heated by heater 511 in dissolving tank 500 for dissolving solid processing agents 518A provided separately from the processing tank 351. The stirring member F is rotated on a timely basis by motor $M_2$ controlled by control section C. In the present example, processing volume of light-sensitive materials is detected by the aforesaid control section C, and the control section C controls so that rotary supply member 521 of the solid processing agent supply device 518 wherein solid processing agents 518A are contained can be rotated depending on the detected processing volume, and solid processing agent 518A can be guided by supply guide 510 to be dropped in the processing solution 512 in the dissolving tank 500. After the operations mentioned above, the processing solution 512 is sent to the processing tank 351 through leading pipe 514 by circulating pump P7.

Even in the present example, a means for sending water in the water tank 516 explained in FIG. 3 to the dissolving tank 500 with bellows pump BP1 and a means for aligning all liquid levels of processing solutions by adjusting the position of dissolving tank 500 vertically are provided, and processing solution circulating tank 400 is affixed on the other side of the processing tank 351, thus, heated processing solution 412 is circulated by circulating pump P1.

Figure 8:
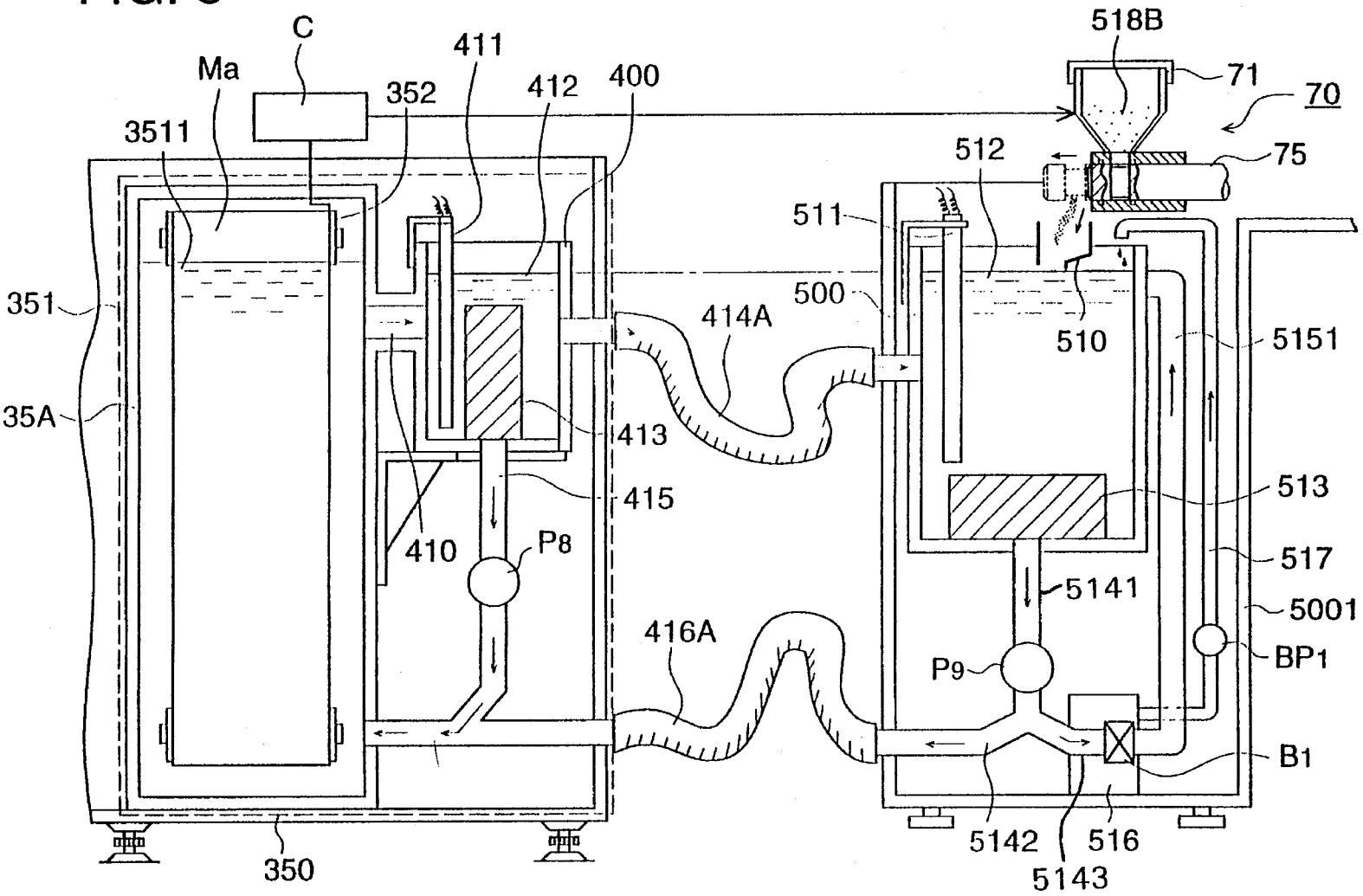
FIG. 8 is still further general structural diagram wherein a processing tank and a dissolving tank both of the present invention are structured separately.

FIG. 8 shows an example other than those shown in FIGS. 3 and 4, 5, 6 and 7. In the example, processing solution circulating tank 400 which is structured solidly with the processing tank 351 is housed in frame body 35A, and dissolving tank 500 provided with processing agent supply device 70 that supplies solid (granular) processing agents 518B, on the other hand, is housed in frame body 5001. As explained above, the processing tank 351 and the dissolving tank 500 are structured to be completely separate from each other by the frame body 35A and the frame body 5001. The processing tank 351 and the processing solution circulating tank 400 both provided in the frame body 35A send processing solution 412 heated by heater 411 to the processing tank 351 by means of circulating pump P8 that is connected to leading pipe 415. On the frame body 5001, on the other hand, hopper 71 containing the solid (granular) processing agent 518B mentioned above is provided on the processing agent supply device 70, and an appropriate quantity of processing agents 518B are guided by supply guide member 510 to be supplied to processing solution 512 by supply member 75. As a supply method, processed quantity of photographic papers of a sheet type Ma represented by the number of rotations of conveyance roller 352 is received by control section C, and the processing agent supply device 70 is operated by the control section C. Processing solution 512 heated by heater 511 is supplied from leading pipe 5141 to be divided into two directions of leading pipes 5142 and 5143 through circulating pump P9. The flow rate in the leading pipe 5143 is adjusted by flow rate adjusting valve $B_1$, and processing solution 512 is circulated to dissolving tank 500 from leading pipe 5151 that is for circulation for the purpose of accelerating dissolution of processing agents 518B. Between the processing solution circulating tank 400 and the dissolving tank 500 in the example, there is attached flexible connecting pipe 414A formed to be slightly longer, and between the leading pipe 5142 and leading pipe 415 of the processing solution circulating tank 400, there is further connected flexible connecting pipe 416A formed to be slightly longer, thus, processing solution 512 is circulated by the circulating pump P9 mentioned above. Processing solution in the dissolving tank 500 and that in the processing tank 351 are set to be on the same level in terms of liquid level.

Figure 9:
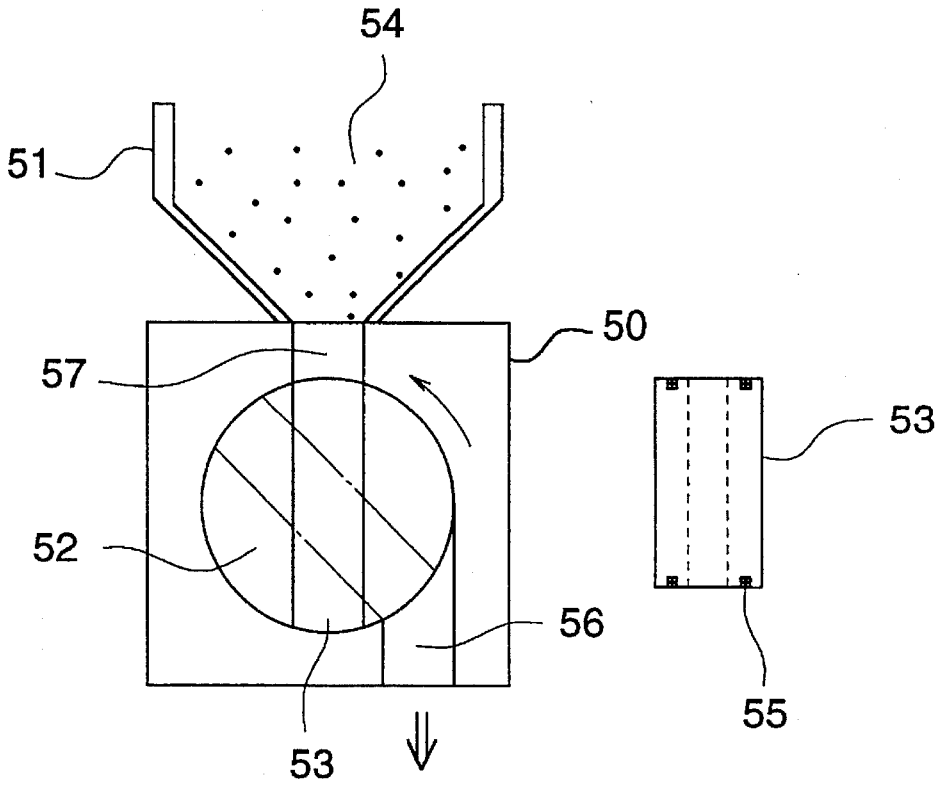
FIGS. 9(A) and 9(B) represent a sectional view 9A of a powder-type processing agent supply device and a perspective view 9(B) of a package both in the comparative example.
Figure 9:
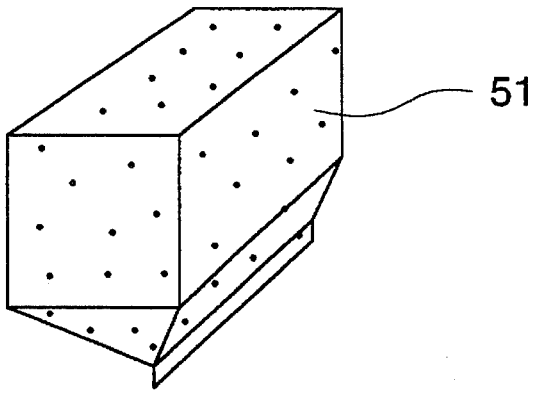

FIGS. 9(A) and 9(B) show another example of a solid processing agent supply device related to the invention, wherein FIG. 9(A) represents a sectional view of a powdery processing agent supply device, while FIG. 9(B) represents a perspective view of a package attached on the supply device. The supply device 50 is composed of a hopper or a package 51 that contains powdery or granular processing agents, measuring hole 53 for measuring powdery processing agents, 54 and rotary drum 52 for supplying a fixed quantity of processing agents. The measuring hole in this rotary drum is deviated from outlet portion 56 for the function of moistureproofing. Incidentally, it is preferable, from the viewpoint of stable operation of supply device 50, that granular processing agents contained in hopper 51 are those having an average particle size of 50 μm–3000 μm. In addition, processing agents each being spherical having a diameter of 0.3–10 mm, the so-called pellet are preferably used. Powdery or granular chemicals in a fixed quantity are measured by the measuring hole 53, then stopped and supplied to a thermostatic portion (a filter tank) of an automatic processing machine through the outlet portion 56 when the rotary drum 52 is rotated by a command of a light-sensitive material processing volume detecting means and thereby the measuring hole 53 is communicated with the outlet portion 56. After the supply of the powdery or granular chemicals to the dissolving tank 500 has been completed, the rotary drum is rotated, then it is stopped when the measuring hole 53 and inlet portion 57 are communicated, so that the measuring of powdery or granular chemicals can be started.

Figure 10:
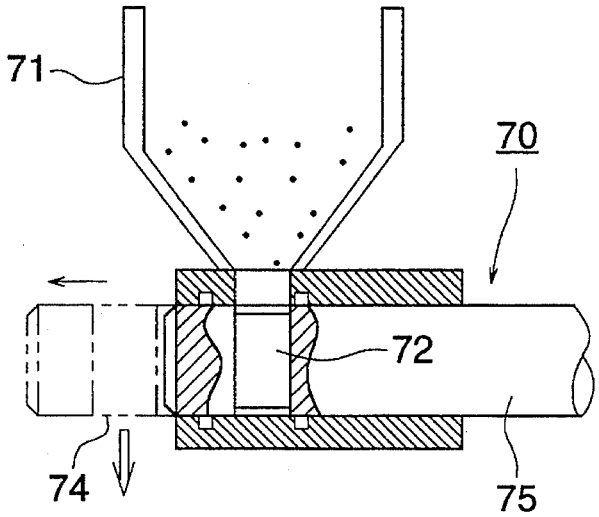
FIG. 10 is a perspective view of another powder-type processing agent supply device.

FIG. 10 is a sectional view showing another supply device.

In supply device 70 wherein powdery processing agents are contained in hopper 71, piston 75 travels horizontally (toward the right in the figure) depending on the light-sensitive material processing volume, then a fixed amount of the powdery agents are put in measuring hole 72 and the piston 75 travels in the reverse direction (toward the left) so that the powdery agents may be supplied to a thermostatic tank (a filter tank) through outlet portion 74.

Figure 11:
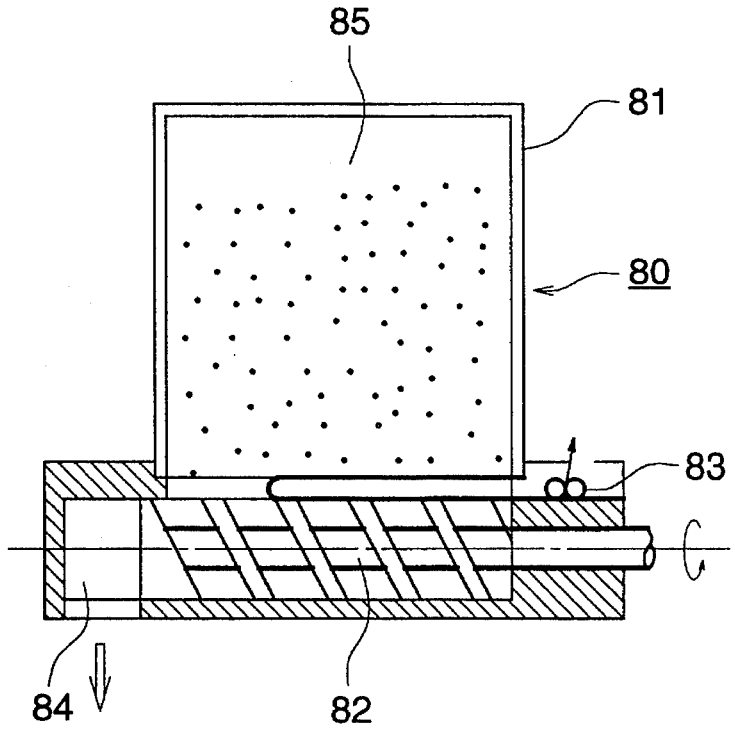
FIG. 11 is a sectional view showing another example of the powder-type processing agent supply device.

FIG. 11 is a sectional view showing still another supply device.

Supply device 80 is one wherein package 81 containing powdery processing agents 85 is attached (loaded), a function to open the seal automatically with roller 83 is provided, and powdery chemicals are supplied through outlet portion 84 by controlling the number of rotations of screw 82.

Due to the function to open the seal of the package automatically, no fine powder scatters when opening the seal of the package and loading the package on the supply device, which is advantageous.

Figure 12:
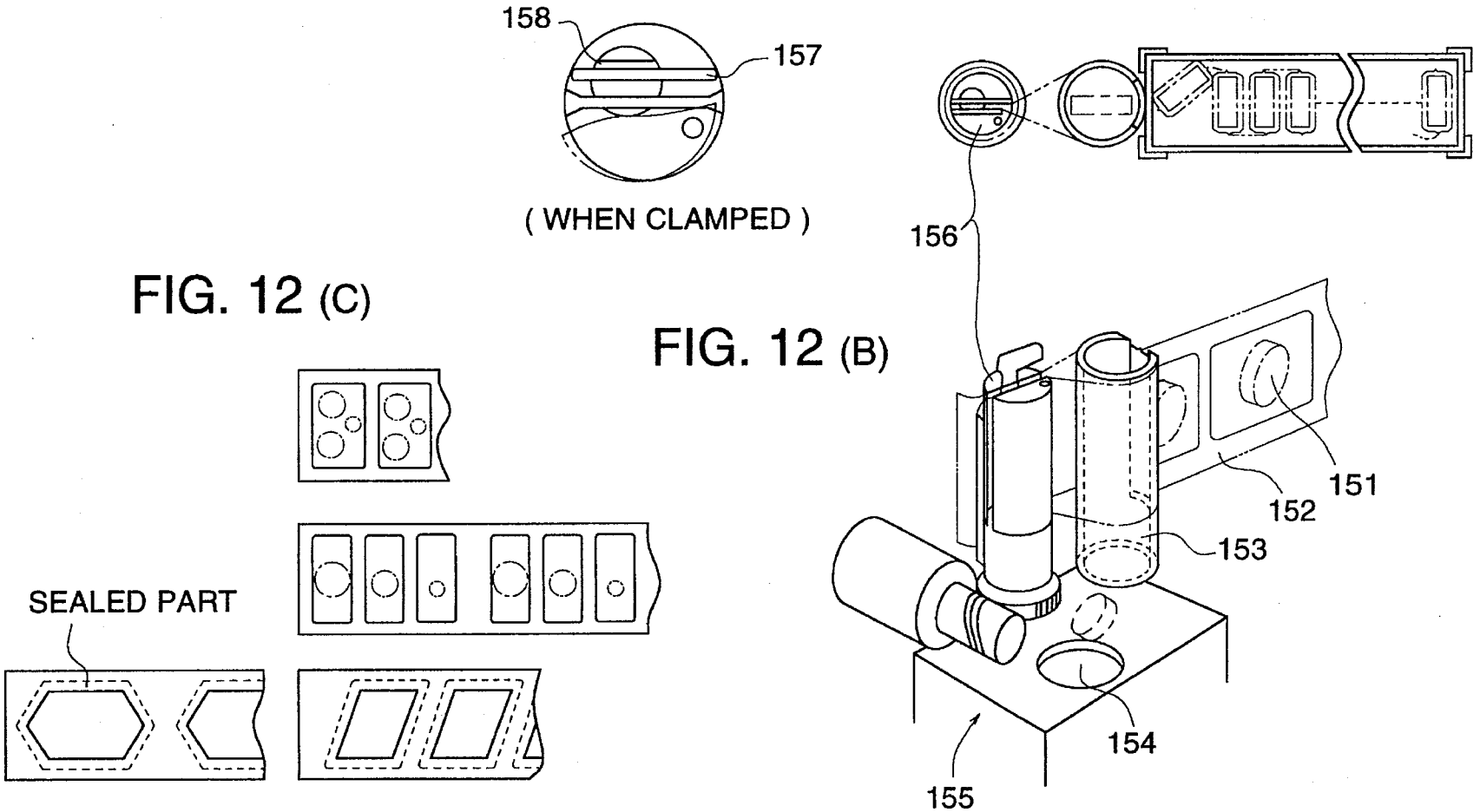
FIGS. 12(A), 12(B) and 12(C) represent top view 12(A) of a device for supplying solid processing agents each being sealed all around, perspective view 12(B) thereof and top view 12 (C) of a package.

FIGS. 12(A), 12(B) and 12(C) show an example of a supply device in another preferable embodiment of the invention, wherein FIG. 12(A) represents a top view, FIG. 12(B) represents a perspective view and FIG. 12(C) represents top views of various package strips.

Processing agent 151 is packed in an individual package sealed surroundedly in the form shown in FIG. 12(C).

A material used for the package in a packing style in FIG. 12(C) that is an example of the invention may be high polymer resin used generally, aluminum, or a composite material, and all the material needs is just one that is excellent in moistureproofing characteristic and is less permeable against oxygen.

Processing agent 151 sealed surroundedly is taken out through the separation of a package strip made by cylinder 153, and is supplied to a supply portion 155 through supply inlet 154. In this case, the cylinder 153 and take-up shaft 156 serve as a processing agent supply means. It is so structured as to take up the package strip 152 with the take-up shaft 156, and taking-up of the package strip is controlled by a processing agent supply means that receives signals from a light-sensitive material processing volume detecting means. For taking up the package strip, a knob 157 is opened, then the package strip 152 is set, through a cylinder located at the leading edge of the package strip 152, on the take-up shaft 156 that is a fixing means for the package strip and the knob 157 is twisted so that the package strip may be fixed and taken up by a clamp 158.

Figure 13:
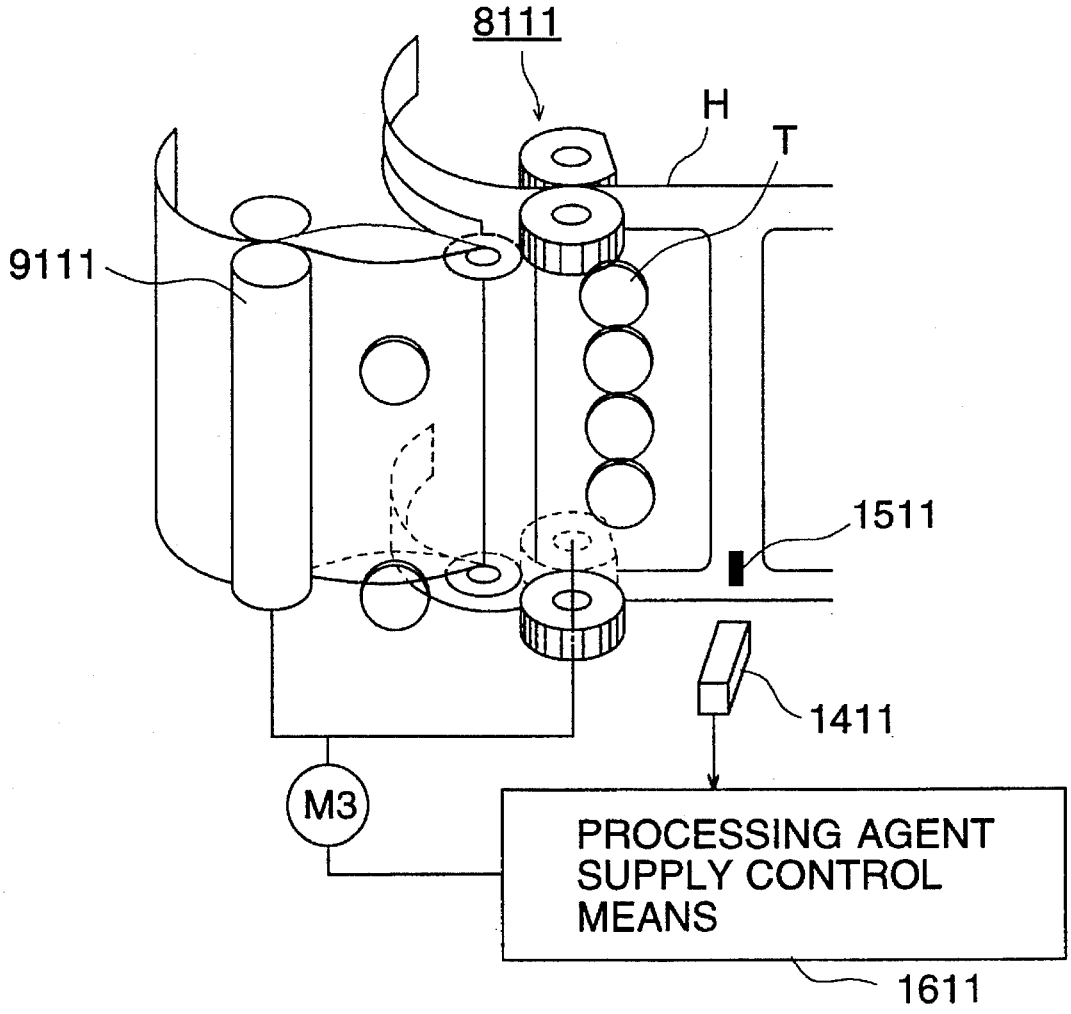
FIG. 13 is a perspective view explaining a supply device which peels off sealed portions of the package so that a solid processing agent may fall.

Detecting means 1411 shown in FIG. 13 detects portion-to-be-detected 1511 recorded on the side edge of each individual package in processing agent package strip H storing processing agent T, then sends signals to processing agent supply control means 1611, and controls a motor M3 to drive the first conveyance means 8111 and the second conveyance means 9111. It is indicated that it is used also for residual quantity indication.

Figure 14:
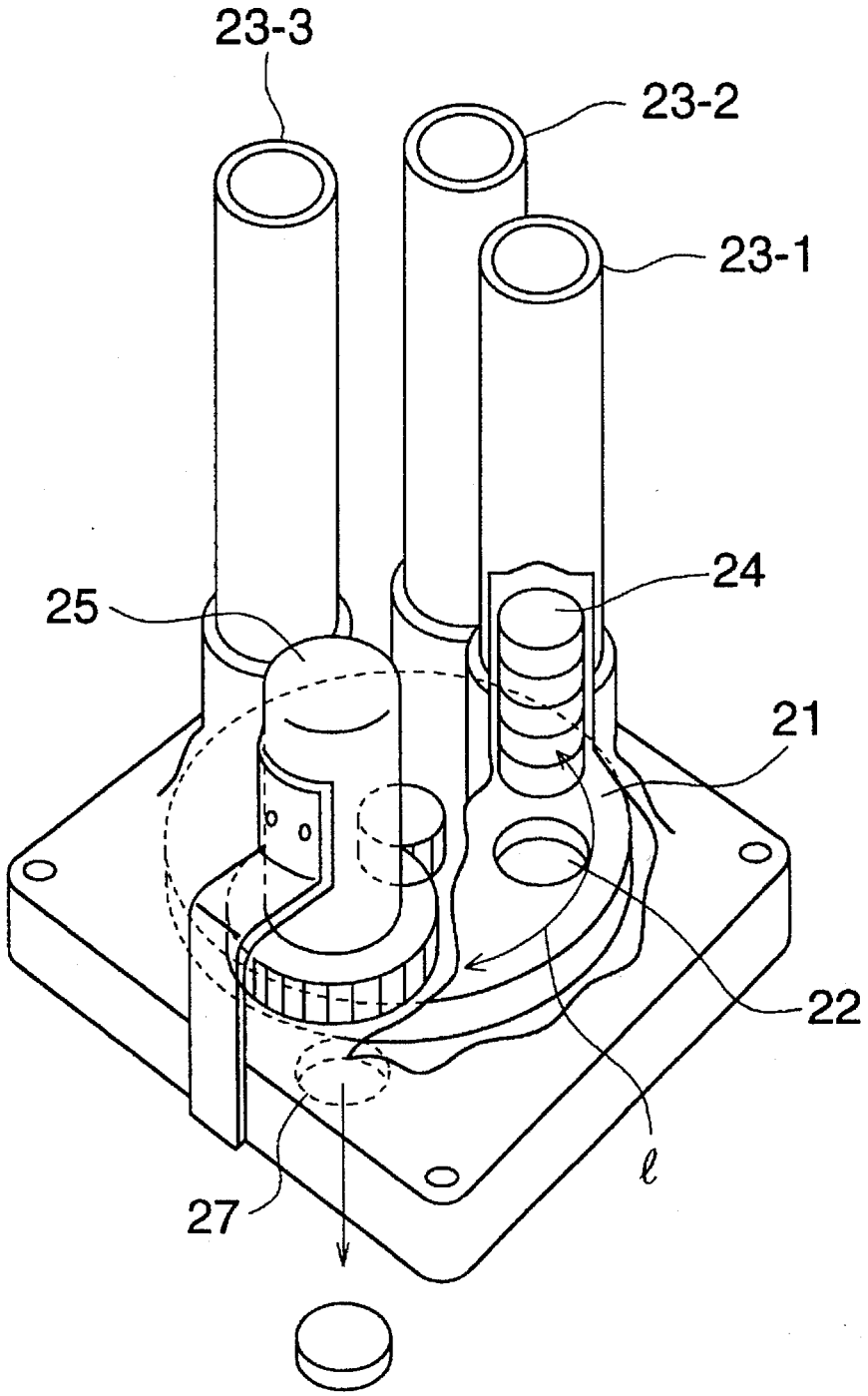
FIG. 14 is a perspective view of a solid processing agent replenishing device.

FIG. 14 is a perspective view of a supply means for solid processing agents used in the invention. Solid processing agent containing cylinders 23-1, 23-2 and 23-3 are arranged on an orbit of dropping hole 22 over circular turntable 21, and every time the turntable 21 is caused by motor 25 to make one turn, solid processing agent 24 is brought to supply inlet 27 while being held in the dropping hole 22 so that the solid processing agent 24 can be supplied to a processing tank. A horizontal moving distance l in this case represents a locus of the processing agent moving from the center of the position where it is set to the center of the supply inlet, and design and installation are carried out so that the value of the horizontal moving distance may be within the range of the invention. From the viewpoint of moistureproofing, it is preferable that the solid processing agent containing cylinders 23-1, 23-2 and 23-3 are provided with a cover.

Figure 15:
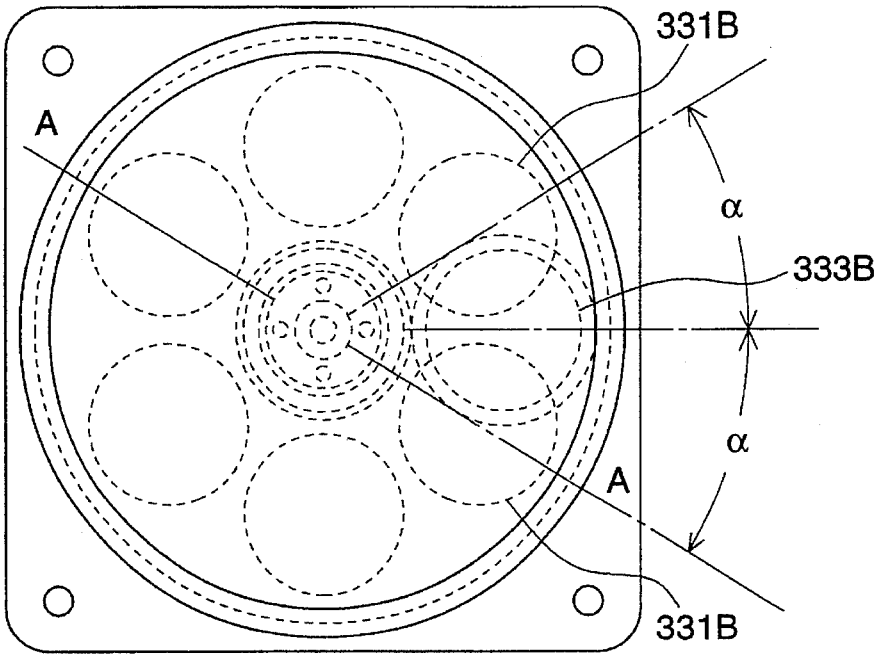
FIGS. 15(A) and 15(B) represent top view 15(A) and sectional view 15(B) taken on line A—A of FIG. 15(A) of another solid processing agent replenishing device.
Figure 15:
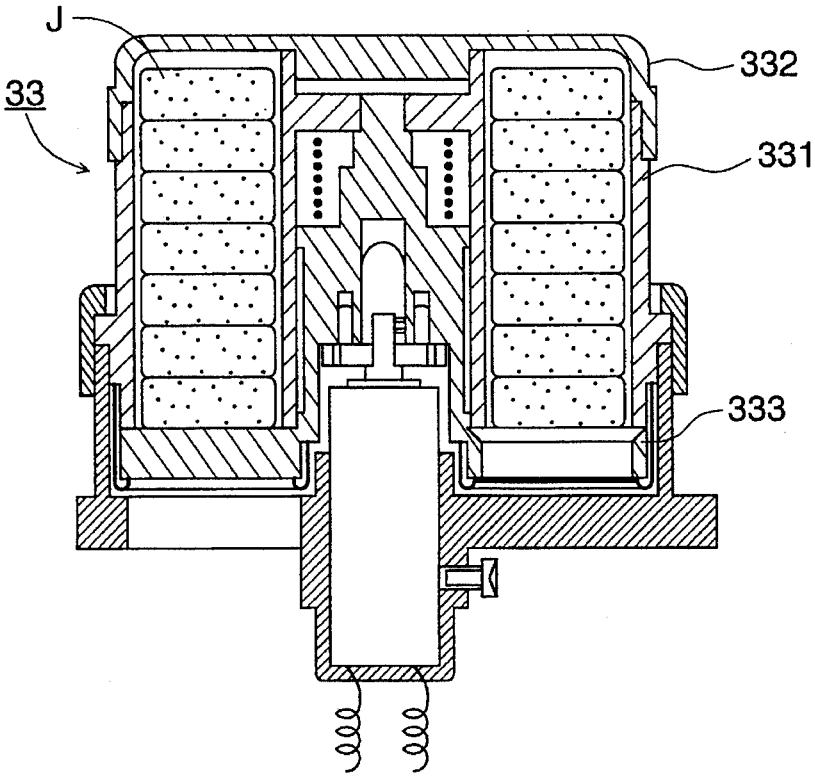

In FIGS. 15(A) and 15(B), when filling container 33 with solid processing agents J, an upper portion of container main body 331 is opened by removing cap member 332, and each of hollow-cylinder-shaped chambers 331B at six locations is filled with stacked solid processing agents J. When hole portion 333B of rotary conveyance member 333 is located at the middle point between two dropping holes of hollow-cylinder-shaped chambers 331B of the container main body 331, namely at the middle point between angles α which are mostly the same in FIG. 15(A) in the case of the filling mentioned above, it is not feared that solid processing agent J falls outside the container 33.

It was utterly unpredictable that density variation of processing solutions caused by direct replenishment of solid processing agents to the processing solutions can further be reduced and process stability especially in the case of small volume processing can be improved, in addition to the achievement of the aforementioned objects, due to a circulating path in a processing tank of an automatic processor wherein a dissolving tank is communicated with the processing tank by a communicating means. This is a superb effect. This indicates that the same dissolving and replenishing device can be used without modifying complicated control on the device when composition of processing agents and a replenishing amount are changed. It further indicates that the same dissolving and replenishing device can be used for a plurality of automatic processing machines, resulting in remarkable improvement in convenience of users.

What is claimed is:

1. A device for dissolving a solid processing agent so as to make a dissolved solution and for replenishing the dissolved solution to an automatic processing apparatus for a silver halide photographic light-sensitive material, said automatic processing apparatus having a processing tank for containing a processing solution and a processing solution circulating tank connected to the processing tank for circulating the processing solution between the processing tank and the processing solution circulating tank, said device comprising:

(a) a dissolving tank for dissolving the solid processing agent to make the dissolved solution therein;

(b) means for supplying the processing solution from said automatic processing apparatus to the dissolving tank;

(c) means for replenishing the dissolved solution from the dissolving tank to the automatic processing apparatus;

whereby the processing solution circulates between the automatic processing apparatus and said device; and (d) adjusting means for adjusting a position of the dissolving tank.

2. The device of claim 1, further comprising:

(d) means for supplying the solid processing agent to the dissolving tank.

3. The device of claim 1, wherein said dissolving tank comprises means for circulating the dissolved solution.

4. The device of claim 1, wherein said adjusting means adjusts the position of the dissolving tank such that a height of a liquid-level in said processing tank is substantially the same as a height of a liquid-level in said dissolving tank.

5. The device of claim 1 further comprising:

supply control means for controlling said supply means.

6. The device of claim 5 wherein said supply control means controls said supply means so that solid processing agent can be supplied to said dissolving tank according to information of volume of the silver halide light-sensitive material processed in said automatic processing apparatus.

7. The device of claim 5, wherein said supply control means controls said supply means so that solid processing agent can be supplied to said dissolving tank according to information of the solid processing agent supplied.

8. The device of claim 1 further comprising:

a water-supply tank;

water-supply means for supplying water from said water supply tank to said dissolving tank; and water-supply control means for controlling said water-supply means.

9. The device of claim 1 further comprising:

a control means for controlling dissolution of solid processing agent.

10. The device of claim 9, wherein said dissolution control means controls the dissolution of solid processing agent according to information of volume of the silver halide light-sensitive material processed in said automatic processing apparatus.

11. The device of claim 9, wherein said dissolution control means controls the dissolution of solid processing agent according to information of the solid processing agent supplied.

12. The device of claim 9, wherein said dissolution control means comprises stirring means employing a propeller.

13. The device of claim 9, wherein said dissolution control means comprises a liquid flow stirring means employing a circulating pump.

14. The device of claim 9, wherein said dissolution control means and said means for replenishing the dissolved solution from said dissolving tank to said processing tank comprise a same circulation pump.

15. The device of claim 9, wherein said dissolution control means comprises means for producing supersonic waves.

16. The device of claim 1, wherein said dissolving tank comprises a plurality of dissolving tanks each containing a processing solution of a different formula.

17. An automatic processing apparatus connected with a device for dissolving a solid processing agent so as to make a dissolved solution and for replenishing the dissolved solution to an automatic apparatus which is for a silver halide photographic light-sensitive material, said automatic processing apparatus having a processing tank for containing a processing solution and a processing solution circulating tank connected to the processing tank for circulating the processing solution between the processing tank and the processing solution circulating tank, said device comprising:

(a) a dissolving tank for dissolving the solid processing agent to make the dissolved solution therein;

(b) means for supplying the processing solution from said automatic processing apparatus to the dissolving tank; and (c) means for replenishing the dissolved solution from the dissolving tank to the automatic processing apparatus, whereby the processing solution circulates between the automatic processing apparatus and said device.

18. The apparatus of claim 17, further comprising:

means for adjusting a position of the dissolving tank.

19. The apparatus of claim 17, further comprising:

means for supplying the solid processing agent to the dissolving tank.

20. The apparatus of claim 17, further comprising:

a water-supply tank;

water-supply means for supplying water from said water supply tank to said dissolving tank; and water-supply control means for controlling said water-supply means.

* * * * *